United States Patent [19]

Schiele et al.

[11] 4,231,348

[45] Nov. 4, 1980

[54] IGNITION SYSTEM WITH IGNITION CURRENT AND MINIMUM SPARK DURATION CONTROLS

[75] Inventors: Werner Schiele, Ludwigsburg; Richard Schleupen, Ingersheim, both of Fed. Rep. of Germany

[73] Assignee: Robert Bosch GmbH, Stuttgart, Fed. Rep. of Germany

[21] Appl. No.: 973,598

[22] Filed: Dec. 27, 1978

[30] Foreign Application Priority Data

Dec. 31, 1977 [DE] Fed. Rep. of Germany ..... 2759153

[51] Int. Cl.[3] ..... F02P 3/04

[52] U.S. Cl. ..... 123/644; 123/440; 315/209 T

[58] Field of Search ..... 123/148 E, 117 R, 117 D, 123/119 EC; 324/15, 16 R; 315/209 R, 209 T, 209 M

[56] References Cited

U.S. PATENT DOCUMENTS

| | | | |
|---|---|---|---|
| 4,008,696 | 2/1977 | Gartner | 123/148 E X |
| 4,106,447 | 8/1978 | West | 123/148 E X |
| 4,153,032 | 5/1979 | Chateau | 123/148 E |

*Primary Examiner*—Tony M. Argenbright

*Attorney, Agent, or Firm*—Frishauf, Holtz, Goodman & Woodward

[57] ABSTRACT

To prevent misfires, the current through an ignition coil is increased in response to an error signal indicating that the actual spark duration was less than a predetermined minimum spark duration. At the start of the spark, a capacitor is discharged at a known rate. The time required for the voltage across the capacitor to reach a predetermined level is the desired spark duration. This regulation of ignition current causes the spark duration to be very close to the minimum spark duration, thereby cutting losses in the apparatus.

13 Claims, 1 Drawing Figure

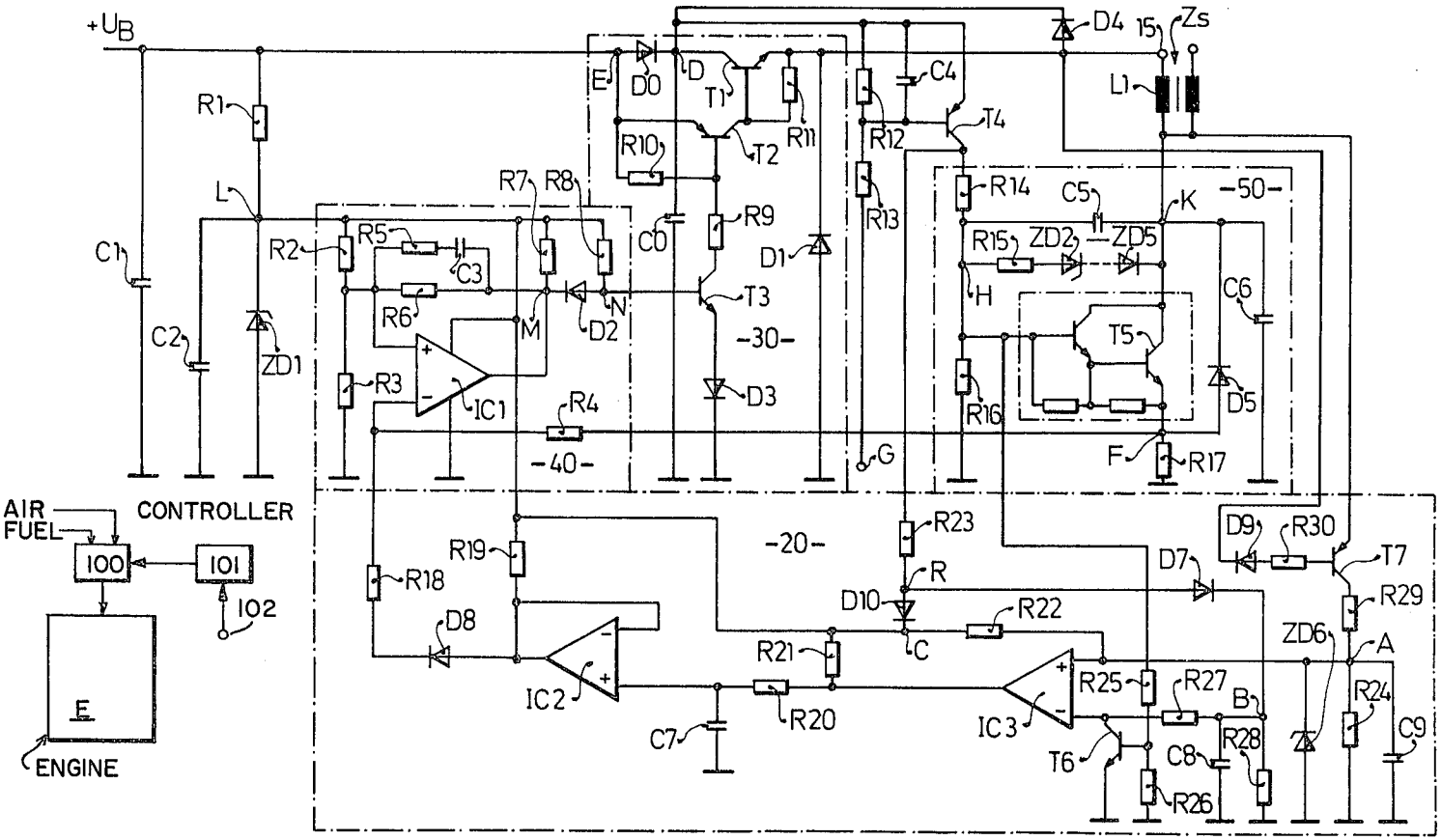
Zs
15
D4
L1
K
-50-
C6
D5
R17
F
T5
ZD5
C5
ZD2
R15
H
R16
R14
T4
C4
R12
R13
G
R11
T2
T1
D
D0
E
R10
D1
R9
T3
-30-
D3
C0
N
D2
R8
R7
M
R4
-40-
IC1
C3
R5
R6
R3
R2
ZD1
R1
L
C2
C1
+UB
T7
R29
A
R24
C9
R30
ZD6
D9
B
R28
R27
C8
R26
D7
R25
T6
R22
IC3
R23
R
C
D10
-20-
R21
R20
C7
IC2
R19
D8
R18
CONTROLLER
101
102
100
AIR
FUEL
E
ENGINE

IGNITION SYSTEM WITH IGNITION CURRENT AND MINIMUM SPARK DURATION CONTROLS

Cross reference to related applications and publications:

German Patent Publication-AS 2,244,781.

The present invention relates to ignition systems and in particular to ignition system in internal combustion engines. Even more particularly, it relates to ignition systems having ignition current control circuits.

BACKGROUND AND PRIOR ART

In a known ignition system disclosed in German Pat. publication DT-AS 2,244,781, the ignition current required to build up a magnetic field in the ignition coil is controlled by means of a closure control circuit. The closure control circuit operates in response to a sensor which furnishes a signal over a predetermined angular rotation of a shaft of the engine. In the known system, the closure angle is varied as a function of engine speed, the closure angle decreasing with decreasing engine speed and increasing with increasing engine speed. This arrangement has the disadvantage that ignition current control operates only as a function of engine speed. Changes in ignition voltage and spark duration for different loads of the engine, for example for increased capacitive loads or as a result of dirty spark plugs are not taken into consideration.

THE INVENTION

It is an object of the present invention to provide an ignition system for an internal combustion engine which does not have the above-mentioned disadvantages.

In accordance with the present invention, the current regulating means which regulate the ignition current which builds up the magnetic energy in the ignition coil operate in part under control of spark duration control means. The latter respond to spark current flowing through the ignition coil during the spark and furnish a spark duration increase signal to the current regulating means when the actual spark duration is less than a desired minimum spark duration. The so-applied spark duration increase signal causes the current regulating means to increase the ignition current until the actual spark duration becomes equal to the desired minimum spark duration. Compensation is thus achieved for various operating conditions which would otherwise cause misfires such as, for example, disconnection of an ignition cable, differences in ignition cable capacitances or dirty spark plugs. Further, a protective circuit is connected to the circuit to protect it from inadvertent reversals of supply voltage polarity. The circuit does not result in any substantial additional losses in the ignition system.

DRAWINGS

The single FIGURE is a schematic diagram of the circuit of the ignition system.

DESCRIPTION OF THE PREFERRED EMBODIMENT

The single FIGURE shows an ignition coil $Z_S$ having a primary winding L1 which is connected through a switching stage 30 to the positive side of the voltage supply $U_B$ and through an output stage 50 to a reference potential such as ground or chassis. A capacitor C1 is connected in parallel with the voltage supply. Output stage 50 includes a voltage divider with resistors R14 and R16, the latter being connected to ground potential. Resistor R14 is connected to the collector of a driving transistor T4 whose base is connected through a resistor R12 to a connecting terminal D and through a resistor R13 to an input terminal G. Input terminal G is connected to a closure control circuit which controls the time throughout which the transistor T4 is conductive, that is the time during which magnetic energy builds up in ignition coil $Z_S$. The closure control circuit is well known and includes, for example, an inductive sensor which senses a predetermined position of a shaft of the engine and whose output is connected to an operational amplifier acting as a Schmitt trigger. A capacitor C4 is connected between the base and emitter or transistor T4.

The common point H of resistors R14, R16 is connected through a resistor R15 and Zener diodes ZD2-5 to a connecting terminal K. A capacitor C5 is connected in parallel with a series circuit including resistor R15 and the Zener diodes. Further, connecting terminal K is connected to one end of the primary winding L1 of ignition coil $Z_S$. The primary winding L1 of ignition coil $Z_S$ is connected to a connecting terminal F through the emitter-collector circuit of a transistor T5. Terminal F is connected to reference or ground potential through resistor R17. A diode D5 is connected from terminal F to terminal K. A capacitor C6 is connected between terminal K and reference or ground potential.

Terminal F is further connected through a resistor R4 to the inverting input of an operational amplifier IC1. Operational amplifier IC1 forms part of a current regulating stage 40. The supply voltage for operational amplifier IC1 is supplied from a terminal L which is connected to the positive side of the power supply through a resistor R1. Terminal L is connected to reference or ground potential through the parallel combination of a capacitor C2 and a Zener diode ZD1. The direct input of operational amplifier IC1 is connected to terminal L through a resistor R2 and to the output of operational amplifier IC1 through a resistor R6 connected in parallel with a series circuit including a resistor R5 and a capacitor C3. The output of operational amplifier IC1 is applied to a terminal M which is connected through a resistor R7 to terminal L, and is further connected through a diode D2 to a terminal N. Terminal N is connected to terminal L through a resistor R8. Terminal N is also directly connected to the base of a transistor T3.

Transistor T3 constitutes an electronic switch. The emitter of transistor T3 is connected to reference or ground potential through a diode D3, while the collector of transistor T3 is connected through a resistor R9 and a resistor R10 to a terminal E which is directly connected to the positive side of the supply. The common point of resistors R9 and R10 is connected to the base of a transistor T2. The emitter of transistor T2 is connected to terminal E while its collector is connected through a resistor R11 to the primary winding L1 of ignition coil $Z_S$. The collector of transistor T2 is further connected to the base of a transistor T1. The emitter-collector circuit of transistor T1 is connected in series with the primary winding L1 of ignition coil $Z_S$. Specifically, the collector of transistor T1 is connected through a diode D0 to the positive side of the power supply and through a diode D4 to the primary winding of the ignition coil, while its emitter is directly connected to the primary winding of the ignition coil. The collector of transistor T1 is further connected through a resistor R12 and a resistor R13 to input terminal G. A capacitor C4 is connected in parallel with resistor R12. Diode D0 protects the system from voltage reversals, while resistor R11 is provided to conduct leakage currents through transistor T2.

A capacitor $C_o$ is connected between terminal D and reference or ground potential. A diode D1 is connected between the emitter of transistor T1 and reference potential. Diode D1, primary winding L1 of ignition coil $Z_s$, transistor T5 and resistor R17 together constitute a holding circuit for the primary winding.

A spark duration control stage 20 includes a transistor T7 whose emitter is connected to the common terminal of the primary and secondary windings of ignition coil $Z_s$ while its collector is connected through a resistor R29 and a resistor R24 to reference potential. The common point of resistors R29 and R24 is designated by A. The base of transistor 17 is connected through a resistor R30 and a diode D9 to a terminal 15 which is connected to one side of primary winding L1 of ignition coil $Z_s$. Terminal A is connected to reference potential through a diode ZD6 and through a capacitor C9. It is further connected to the direct input of an operational amplifier IC3. A resistor R22 is connected from the direct input of operational amplifier IC3 to terminal M. The inverting input of operational amplifier IC3 is connected through a resistor R27 to a terminal B. Terminal B is connected to reference potential through the parallel combination of a resistor R28 and a capacitor C8. The inverting input of operational amplifier IC3 is further connected to reference potential through the emitter-collector circuit of a transistor T6. The base of transistor T6 is connected to reference potential through a resistor R26 and to the base of transistor T5 through a resistor R25. Terminal B is further connected through a diode D7 to a terminal R which in turn is connected through a diode D10 to a terminal C which is directly connected to terminal M. Terminal R is further connected through a resistor R23 to the collector of transistor T4. Diode D10 stabilizes the charging voltage for capacitor C8, while diode D7 decouples capacitor C8 during the time that transistor T4 is blocked and effects temperature compensation for diode D10. Further, a blocking circuit is connected to the inverting input of operational amplifier IC3 which blocks operational amplifier IC3 when transistor T5 is conductive. Specifically, the emitter-collector circuit of a transistor T6 is connected from the inverting input of operational amplifier IC3 to reference potential. The base of transistor T6 is connected to reference potential through a resistor R26 and to terminal H through a resistor R25. The output of operational amplifier IC3 is connected through an integrating circuit including a resistor R20 and a capacitor C7 to the direct input of an operational amplifier IC2. Operational amplifier IC2 acts as a buffer circuit. Further, a resistor R21 is connected from the output of operational amplifier IC3 to terminal C. Resistor R21 and capacitor C7 form a timing circuit which decreases the cutoff current until the minimum acceptable spark duration has been reached. The output of operational amplifier IC2 is directly connected to its inverting input. It is further connected through a load resistor R19 to terminal M and through a decoupling diode D8 and a resistor R18 to the inverting input of operational amplifier IC1.

Operation:

The ignition system of the present invention operates as a minimum spark duration control circuit, since a spark duration control circuit without setting of a minimum spark duration will occasionally result in a misfire. This is particularly the case when the capacitances of the cables leading to the individual cylinders differ from each other. As long as the spark duration exceeds a desired minimum spark duration, the actual value signal applied to the current regulating circuit is increased very slowly that is with a large time constant (e.g. R21 C7=2s). This process continues until the actual spark duration at any given cylinder is less than the desired minimum spark duration. An increase of the desired value for the current regulating circuit which, in the circuit shown in the FIGURE is accomplished by a shifting of the actual value signal in the direction towards zero, is accomplished with a time constant which is approximately 100 times smaller than the time constant for decreasing the desired value. Thus when the actual spark duration is too short, the circuit operates sufficiently rapidly that the next spark will again have the desired minimum spark duration. In this way, the unstable region which exists after shutoff of the ignition current is essentially by-passed.

For multicylinder engines the ignition system of the present invention regulates the spark duration at the individual cylinders in such a manner that the smallest actual spark duration is somewhat under the desired minimum spark duration value. However, the latter value has a corresponding amount of bias.

The desired minimum spark duration is the time which passes until capacitor C8 discharges through a resistor R28 to the voltage which exists at terminal A when electronic switch T7 is blocked. A back swing of the oscillation of ignition coil $Z_s$ has no detrimental effects, since, when the actual spark duration is approximately equal to the desired spark duration, such a back swing does not influence output 13 of operational amplifier IC3. Further, while output transistor T5 is conductive, electronic switch T6 blocks the inverting input of operational amplifier IC3 so that its output remains positive.

The resistors R23, R28 and R27 allow the spark duration to be changed as a function of engine speed. The charging voltage of capacitor C8 is stabilized by diode D10, the latter being temperature compensated by diode D7. Diode D7 in turn decouples capacitor C8 while transistor T4 is blocked.

Second operational amplifier IC2 of the spark duration control stage 20 acts as a buffer. Diode D8 decouples the spark duration control circuit relative to the current regulating circuit. Simultaneously, resistor R18 fixes the required range for the spark duration control.

Since the ignition system of the present invention regulates the spark duration to the minimum required spark duration, the loss in the input driving circuit and in the ignition coil is kept at a minimum. This eliminates the disadvantages which arise in multicylinder engines due to different capacitive loads and different thresholds of the individual cylinders when no minimum spark duration control is supplied. However, the circuit according to the present invention also does not carry any quiescent current. Also, if the cable which furnishes the input pulse to terminal G drops off or other disturbances occur which result in a continuous conduction of output transistor T5, the current through the ignition coil is limited to a predetermined minimum value by resistor R18 after a time fixed by the timing circuit consisting of resistor R21 and capacitor C7. The ignition system of the present invention operates, at any given blocking time, to cause the spark current at the end of the blocking time to be zero, since the minimum desired spark duration at very small blocking times becomes smaller than the blocking time developed in the current supplied by the circuit. Alternatively regulation can take place via the positive edge at terminal A in the region of residual energy use. For small shutoff currents, that is for small residual energies, the positive edge appears after some delay, causing an increase in the desired current value. In this case the spark current is not zero at the end of the blocking time. An equilibrium between the charging current at capacitor C7 over resistors R21 and R20 and the discharge current flowing from capacitor C7 through resistor R20 to ground during the delay time of the positive edge at terminal A is established.

If a spark does not occur, the residual energy decreases substantially and the delay time of the positive edge at terminal A increases. This causes an immediate increase of the cutoff current.

In modification of the ignition system of the present invention, the fuel-air ratio in an Otto engine E is varied in part as a function of the cutoff current of the ignition. The cutoff current is a function of a required ignition voltage in an ignition system with minimum spark duration control. Air and fuel are supplied through lines AIR and FUEL to a carburetor 100. For a leaner mixture the cutoff current increases. When the cutoff current is linked with the fuel-air ratio, and the cutoff current is predetermined, a follow-up regulation of the fuel-air mixture can be carried out. In controlled ignition systems, the first or second derivative of the desired or reference value of cutoff current is preferably used as the control magnitude, which is applied to the fuel/air ratio control unit 101, coupled to the carburetor 100 and of any suitable and well known form to vary the fuel/air ratio as a function of a control signal applied to line 102. The signal to line 102 is derived as a function of current in the ignition coil immediately preceding ignition.

In a further modification of the ignition system of the present invention, the ignition energy is varied as a function of the operating condition of the motor, thereby providing a protection against excessive thermal loads. Specifically, the specification of different desired values (variable threshold values) causes the available ignition voltage to be matched optimally to the actually required ignition voltage. Measured values may be furnished by sensors such as a starter terminal, engine E no load and full load contacts as well as pressure and temperature sensors.

Detailed Operation:

The signal applied at terminal G of the FIGURES is a pulse whose pulse width determines the length of time that current flows through the ignition coil. the trailing edge of the pulse at terminal G determines the ignition time, that is the time at which the current through the primary winding L1 of ignition coil Zs is interrupted, causing the high voltages to be generated across secondary which cause the spark to be initiated. Let it first be assumed that the negative pulse which determines the spark duration is being applied at terminal G. This causes transistor T4 to become conductive. When transistor T4 becomes conductive, the voltage at its collector rises, causing the voltage at the base of transistor T5 to become more positive, thereby switching transistor T5 to the conductive state. At the same time, as will be discussed in greater detail below, the output voltage of current regulator state 40 is sufficiently positive to cause transistor T3 to be conductive. When transistor T3 is conductive, the voltage at the base of transistor T2 is sufficiently negative to allow transistor T2 to conduct, in turn causing transistor T1 to be conductive. Current thus flows from the battery through diode D0, the emitter-collector circuit of transistor T1, the primary winding L1 of ignition coil Zs, the emitter-collector circuit of transistor T5, and resistor R17 to ground. The voltage across resistor R17 is applied through a resistor R4 to the inverting input of operational amplifier IC1. This voltage is superimposed upon a DC level established by spark duration control circuit 20 as will be discussed in greater detail below. The direct input of operational amplifier IC1 is at a positive voltage level determined by Zener diode ZD1 and the voltage divider ratio of resistors R2 and R3. As the voltage across resistor R17 builds up due to the build-up of current through primary winding L1, the voltage at the output of operational amplifier IC1 remains constant until the voltage at its inverting input is approximately equal to the voltage at its direct input. At this point the output voltage (voltage at terminal M) starts to decrease. This decrease is differentiated by differentiating circuit including resistor R5 and capacitor C3 and a negative going pulse is applied at the direct input of operational amplifier IC1. This reinforces the flipping action and the output voltage of operational amplifier IC1 changes to a level slightly above ground potential. The decrease in voltage at terminal M allows diode D2 to become conductive causing a substantially instantaneous drop in the voltage level at terminal M. This cuts off transistor T3 in turn cutting off transistors T2 and T1. Current flow through winding L1 is maintained by diode D1. However, the current flow will tend to decrease, decreasing the voltage at terminal F, namely the inverting input of operational amplifier IC1. The decrease continues until a threshold value is again reached at which the voltage at terminal M tends to increase slightly. This slight increase is again differentiated and a positive going pulse applied to the positive input of operational amplifier IC1. This positive going pulse reinforces the switching action and the voltage at terminal M returns to the positive value (e.g. six volts). Diode D2 blocks, the voltage at terminal M becomes positive, transistors T3, T2 and T1 return to the conductive state and the current through primary winding L1 again builds up. This action is repeated until the time of the trailing edge of the pulse applied at terminal G, at which time transistor T5 blocks, causing the spark to be generated.

The action of spark control stage 20, which generates a DC level biasing the inverting input of operational amplifier IC1 will now be discussed. Before the spark, transistor T7 is blocked, since the voltage at its base is more positive than the voltage at its emitter. A small DC level exists at terminal A as determined by resistors R1, R22 and R24. While transistor T4 is conducting, a positive voltage is applied to the base of transistor T6. The inverting input of operational amplifier IC3 is therefore connected substantially to ground potential. At the same time, capacitor C8 is charged through the emitter-collector circuit of transistor T4, resistor R23 and diode D7.

If now transistors T4 and T5 block, blocking of transistor T4 causes a negative voltage to be applied to the anode of diode D7. The charging process of capacitor C8 is stopped and it begins to discharge through resistor R28. At the same time, a negative voltage is applied to the base of transistor T6, since the voltage at point H is now ground potential. Transistor T6 blocks allowing the voltage across capacitor C8 to be applied to the inverting input of operational amplifier IC3.

After transistor T5 has blocked, a large positive voltage appears across primary winding L1 causing the emitter of transistor T7 to become positive with respect to its base. Transistor T7 becomes conductive. The voltage at terminal A rises rapidly to a value limited by Zener diode ZD6. As the voltage across the secondary winding decreases to the maintaining voltage for the spark, the voltage at terminal A remains constant. Since the voltage at the inverting input of operational amplifier IC3 is slowly decreasing during the spark time, the voltage at the output of operational amplifier IC3 increases slowly during this time.

At the end of the spark the voltage at point K undergoes a number of rapidly damped oscillations. The first downswing, which coincides with the end of the spark, causes the voltage at the emitter of transistor T7 to become positive with respect to its base voltage and transistor T7 blocks. Voltage at terminal A rapidly drops to the DC level existing before the spark. If, at this time, the voltage at the inverting input of operational amplifier IC3 is higher than the DC level at terminal A, the output of operational amplifier IC3 will switch to a low state and remain in the low state until such time as the voltage across capacitor C8 has decreased to a value slightly below the level of terminal A. Throughout this time the output of operational amplifier IC3 will remain at the low level. A negative pulse at the output of operational amplifier IC3 thus has a pulse width which is indicative of the difference between the actual and desired spark duration, and, more specifically, indicative of this difference when the actual spark duration is less than the desired spark duration.

Resistor R20 and capacitor C7 form an integrating network for the output of operational amplifier IC3. Also, capacitor C7 is charged at a very slow rate from the battery through resistor R1 and resistor R21. The negative pulse at the output of operational amplifier IC3 causes a decrease of voltage across capacitor C7 at a high rate relative to the charging rate through resistor R21. The voltage at the direct input of operational amplifier IC2 decreases, as does the voltage at its output. This decrease causes a decrease in the DC level at the inverting input of operational amplifier IC1 via diode D8 and resistor R18. This decrease causes operational amplifier IC1 to increase the current through primary winding L1 of ignition coil Zs as was described above. This increase in current causes an increase in the next subsequent spark duration.

The circuit of the present invention thus operates immediately to increase the spark duration when the spark duration falls below a predetermined minimum spark duration. This prevents misfires which might otherwise occur in a circuit with current regulation only.

Various changes and modifications may be made within the scope of the inventive concepts.

We claim:

1. In an ignition system having ignition coil means (Zs), means (T5) for producing an ignition current in said ignition coil means, and means connected to said ignition coil means for producing a spark upon interruption of said ignition current in said ignition coil means:

apparatus for controlling said ignition current to produce a spark having a predetermined desired spark duration comprising current control means (40,T1) connected to said ignition coil means for controlling said ignition current in correspondence to a current control signal applied thereto;

means (C8, R28) for furnishing a desired spark duration signal corresponding to said predetermined desired spark duration;

means (T7) connected to said ignition coil means for furnishing an actual spark duration signal corresponding to the actual duration of said spark produced by said spark producing means;

means (IC3) connected to said desired spark duration signal furnishing means and said actual spark duration signal furnishing means for furnishing an error signal corresponding to the difference therebetween;

and connecting means (R20, C7, IC2) for applying said error signal to said current control means to change said current control signal in a direction for controlling said ignition current to change said actual spark duration in a direction decreasing said error signal.

2. Apparatus as set forth in claim 1, wherein said connecting means comprises integrator means for changing said current control signal at a first predetermined rate in response to error signals indicative of an actual spark duration less than said desired spark duration and at a second rate substantially slower than said first rate in response to error signals indicative of an actual spark duration exceeding said desired spark duration.

3. Apparatus as set forth in claim 2, wherein said ignition current producing means comprises main switch means (T5) having an output circuit connected in series with said ignition coil means and a control circuit, and closure control means (T4) connected to said control circuit for switching said output circuit to a conductive state in response to an externally applied closure control signal and for maintaining said output circuit in a nonconductive state in the absence of said closure control signal;

and wherein said current control means comprises control switch means (T1) connected in series with said ignition coil means and having a conductive state in response to a current increase signal and a nonconductive state in response to a current decrease signal, means (40) connected to said control switch means for furnishing said current increase and current decrease signals in response to said current control signal, and means (D1) for maintaining ignition current in said ignition coil means when said control switch means is in said nonconductive state and said output circuit of said main switch means is conductive, whereby ignition current flows through said ignition coil means throughout the time said output circuit of said main switch means is conductive.

4. Apparatus as set forth in claim 3, wherein said means for furnishing said current increase and said current decrease signals comprises first operational amplifier means (IC1) having an inverting input connected to receive said current control signal, a direct input for receiving a current reference signal and an output for furnishing said current increase and current decrease signal in correspondence to the difference between said current reference signal and said current control signal.

5. Apparatus as set forth in claim 4, wherein said means for producing an ignition current in said ignition coil comprises resistor means (R17) connected in series with said ignition coil means, whereby the voltage across said resistor means corresponds to said ignition current; further comprising means (R4) for connecting said resistor means to said inverting input of said first operational amplifier means, whereby said current control signal changes as a function of changes in said ignition current in said ignition coil means.

6. Apparatus as set forth in claim 5, wherein said means for furnishing a spark duration error signal comprises second operational amplifier means (IC3) having a first input for receiving said actual spark duration signal, a second input for receiving said desired spark duration signal and an output for furnishing said spark duration error signal.

7. Apparatus as set forth in claim 6, wherein said means for furnishing said desired spark duration signal comprises a capacitor (C8) connected to said second input of said second operational amplifier means, charging means (R23, D7) for charging said capacitor to a predetermined level while said ignition current flows in said ignition coil means, and discharge means (R28) connected to said capacitor for discharging said capacitor at a constant rate following interruption of said ignition current in said ignition coil means;

and wherein said means for furnishing an actual spark duration signal comprises means for applying a first predetermined DC voltage to said first input of said second operational amplifier means in the absence of said spark and means (T7) for applying a second predetermined DC voltage different from said first predetermined voltage to said first input of said second operational amplifier means during said spark.

8. Apparatus as set forth in claim 7, wherein said first and second input of said second operational amplifier means are a direct and an inverting input, respectively;

wherein said second predetermined DC voltage has an amplitude exceeding the amplitude of said first predetermined DC voltage;

and wherein said second operational amplifier means furnishes an error signal indicative of an actual spark duration less than said desired spark duration if said voltage at said direct input changes from said second to said first predetermined DC voltage before said capacitor has discharged to a level corresponding to said first DC voltage.

9. Apparatus as set forth in claim 8, wherein said error signal indicative of an actual pulse duration less than said desired pulse duration is a pulse having a pulse width corresponding to the difference between said actual spark duration and said desired spark duration.

10. Apparatus as set forth in claim 6, wherein said means for furnishing said second predetermined DC voltage comprises additional switch means (T7) connected to said ignition coil means and said first input of said second operational amplifier means for blocking current from said ignition coil to said first input in the absence of said spark and permitting current flow from said ignition coil to said first input during said spark.

11. Apparatus as set forth in claim 1, wherein said spark producing means further comprises a battery;

further comprising protective circuit means (D0, C0) interconnected between said battery and said control switch means for protecting said apparatus from inadvertent reversals in polarity of said battery.

12. Apparatus as set forth in claim 1, wherein said ignition system is an ignition system in an internal combustion engine having a carburetor;

further comprising means for varying the fuel/air ratio in said carburetor as a function of current in said ignition coil immediately preceding ignition.

13. Apparatus as set forth in claim 1, wherein said ignition system operates in an ambient temperature;

and wherein said current control means further comprises means for controlling said ignition current through said ignition coil means as a function of said ambient temperature.

* * * * *